US005531429A

United States Patent [19]

Clark

[11] Patent Number: 5,531,429

[45] Date of Patent: Jul. 2, 1996

[54] VARIABLE PRINTING AND SELECTIVE BINDING OF BOOKLETS

[75] Inventor: Jay V. Clark, West Liberty, Iowa

[73] Assignee: National Computer Systems, Inc., Minneapolis, Minn.

[21] Appl. No.: 413,162

[22] Filed: Mar. 29, 1995

[51] Int. Cl.[6] ..... B42C 9/00

[52] U.S. Cl. ..... 270/58.11; 355/324; 355/325; 156/908

[58] Field of Search ..... 270/53, 1.1; 355/324, 355/325; 156/537, 323, 289, 908, 385

[56] References Cited

U.S. PATENT DOCUMENTS

| | | | |
|---|---|---|---|
| 3,793,016 | 2/1974 | Eichorn | 355/324 X |
| 3,817,815 | 6/1974 | Sendor et al. . | |
| 3,843,483 | 10/1974 | Sendor et al. . | |
| 3,943,024 | 3/1976 | Sendor et al. . | |
| 4,061,523 | 12/1977 | Sendor et al. . | |
| 4,149,288 | 4/1979 | Sendor et al. . | |
| 4,270,742 | 6/1981 | Kobayashi . | |
| 4,564,185 | 1/1986 | Hamlin et al. . | |
| 4,824,503 | 4/1989 | Wilen | 156/387 X |
| 4,848,231 | 7/1989 | Stienstra | 355/324 X |
| 4,891,681 | 1/1990 | Fiske et al. | 355/324 X |
| 5,014,092 | 5/1991 | Kubo et al. | 355/324 |
| 5,021,273 | 6/1991 | Kobayashi | 156/387 X |
| 5,028,192 | 7/1991 | Lindsay et al. . | |
| 5,113,355 | 5/1992 | Nomura . | |
| 5,114,128 | 5/1992 | Harris, Jr. et al. . | |
| 5,327,526 | 7/1994 | Nomura et al. . | |

*Primary Examiner*—John E. Ryznic
*Attorney, Agent, or Firm*—Merchnt, Gould, Smith, Edell, Welter & Schmidt

[57] ABSTRACT

An apparatus and method for variably printing and electively binding sheets. A printer is used to print variable sets of information onto a plurality of sheets, sequence the printed sheets, and assemble the printed sheets into a stack. Particular sheets within the stack of the printed sheets are selectively bound together. The binding is accomplished using a toner or other adhesive selectively applied to the sheets. This allows for the printing and binding of different booklets from an assembled stack of sheets, for example, without having to remove each booklet from the stack and separately bind it.

32 Claims, 6 Drawing Sheets

VARIABLE PRINTING AND SELECTIVE BINDING OF BOOKLETS

FIELD OF THE INVENTION

The present invention relates to an apparatus and method for printing and binding of sheets.

BACKGROUND OF THE INVENTION

Printing and binding of booklets and similar materials present challenging problems. This is particularly true when a large volume of materials must be printed and bound, obviating use of manual assembly and binding techniques. The problems are compounded when different types, lengths, or contents of documents are to be printed and bound. In this situation, one must generally sort and assemble a series of pages or sheets to be bound in order to separate and bind each of the particular documents within the series.

Normally, such printing is done on offset printing devices producing stacks of sheets with each individual stack containing only one kind of sheet, i.e. stack one has multiple copies of sheet one, stack two has multiple copies of sheet two, and so on. The stacks are then placed in a gathering device with sheets pulled from each stack to create a booklet which is then bound. The result is a large number of identical booklets. This method does not lend itself to producing booklets of different length and content, particularly when they must subsequently be sequenced for use in packages requiring booklets from each of the print/binding processes. Such requirements typically cause pick and pack manual assembly.

However, one often may desire to print and bind a large number of educational test booklets, each of the booklets having possibly different information (content) and numbers of sheets. These booklets may, using computer controlled printers, be first printed on a series of sheets such that a large stack of unbound sheets contains, in appropriate final sequence, the several different test booklets. One must then determine how to separate and bind each of the particular booklets in the series. The binding is made more difficult when, for example, the test booklets each have different lengths. These problems with printing and binding are evident not just in binding test booklets, but in other materials as well.

Printing and binding of varying test booklets may involve the following steps. First, the test booklets are printed on a series of sheets. Second, the sheets are, if necessary, cut down to the appropriate size. Third, the series of sheets are separated into the individual booklets. This may be a complicated step which involves individually separating out the sheets in the series and determining which sheets correspond to each test booklet in order to determine which sheets must be bound together. Fourth, the now separated sheets are bound together.

Singulating is one technique for determining which sheets in a stack are to be bound together. In this technique, a machine receives a series or stack of pages containing the information to be bound together. The machine removes each page from the stack individually. When all sheets for a particular set are separated and grouped together in original sequence, as determined by an indexer, the machine binds together that particular set of sheets. The indexer, therefore, keeps track of which pages are to be bound together. This technique is expensive, however, and complicated when the machine jams. This requires a reprint and insertion of a corrected sheet. In addition, the indexer must be very accurate. If a failure occurs, the resulting booklet will be incorrectly bound due to fewer or greater than desired sheets being included; furthermore, the subsequent booklet by definition will also be faulty.

Using capabilities provided by many printing devices, sheets to be bound into a booklet can be indexed or offset in the stack from subsequent sets of sheets to be bound into booklets. Singulating is no longer required, but lifting unbound sets of sheets from stacks to feed into binding systems presents further complications to the binding process described above. Normal binding techniques do not operate effectively when, in sequencing, the sets to be bound can range from one sheet (i.e., no binding) to hundreds of sheets (i.e., one booklet with 1-N sheets) in uncontrolled and variable sequences.

One common technique for binding together documents is stapling. Stapling, however, also requires that each document to be bound together be removed from a stack of printed sheets. The staples sometimes cause problems. Cross motion of booklets within a stack of booklets (during printing, shipping, etc.) often results in the last page being torn from the grasp of the staple. Also, when a series of stapled documents are stacked on top of each other, the staples often catch on one another. Removing staples is expensive and difficult in the event that the booklet must be returned to individual sheets such as for machine reading and scoring of test booklets.

Another binding technique uses adhesive and tape. The adhesive is applied to the edges of the sheets to be bound together. The tape is then applied over and wrapping around the edge. With adhesive, however, the pages within a stack must still be singulated or handled as variable unbound sets, as mentioned above, in order to remove each of the individual documents to be bound together. In addition, the tape makes stacking of the booklets difficult, since the taped edges have a greater thickness than the other edges of the booklets.

Accordingly, a need exists for improved techniques for printing and binding, particularly binding of varying printed documents within a series of sheets, thereby allowing the power of intelligent, computer controlled printers to fully recognize their potential and produce booklets of various length, content, and sequence as desired.

SUMMARY OF THE INVENTION

The present invention relates to an apparatus and method for variably printing and selectively binding sheets. The invention involves using a printer in order to print variable sets of information onto a plurality of sheets, sequence the printed sheets, and assemble the printed sheets into a stack. Particular sheets within the stack of the printed sheets are selectively bound together.

Therefore, with the present invention one may choose which particular sheets and which particular edge(s) of sheets are to be bound together within the stack of sheets. The present invention thus allows for the printing and binding of different booklets from an assembled stack of sheets, for example, without having to remove each booklet from the stack and separately bind it.

DETAILED DESCRIPTION

Overview

The present invention provides for combining variable printing and selective binding of booklets and other materials. The variable printing allows each document in the series to be different, if necessary. The selective binding means that one may choose which particular sheets or edges of sheets within a stack of sheets are to be bound together. The present invention allows for the binding of those selected sheets without having to remove them from the stack. This means that one may variably print a series of documents and then bind together selected documents within the stack in a single process.

Figure 1:
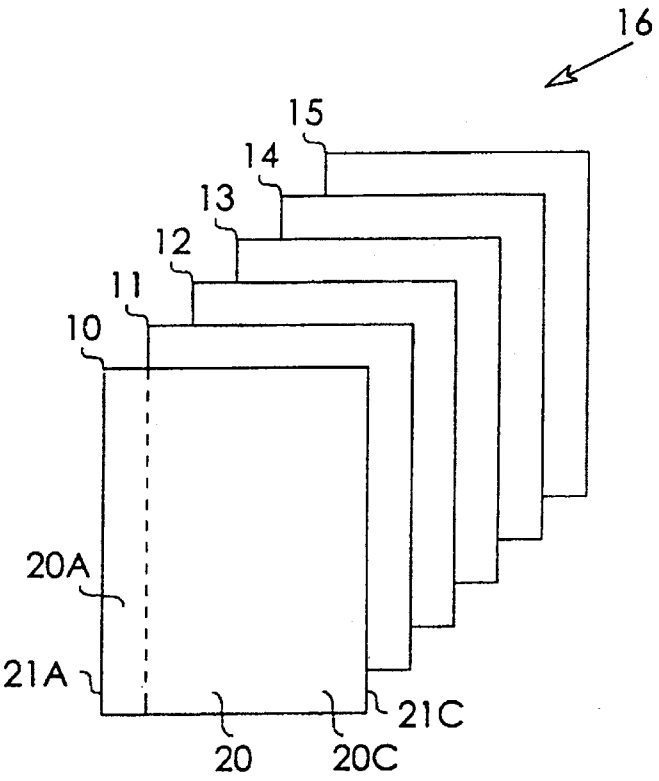
FIG. 1 is a diagram of a stack of sheets to be selectively bound together.

FIG. 1 is a diagram of a stack 16 of sheets 10–15. The sheets 10–15 may contain variable sets of printed information, which means that the assembled stack 16 may contain different documents to be bound together. An example of such documents is different educational test booklets. An educational test booklet is a sequence of sheets bound together and containing administration instructions, and questions or test items, for the purpose of assessing educational achievement and general knowledge application.

The present invention may be used with any information to be printed on sheets which are to be bound together. While "sheets" are typically paper materials and the like, they may also be any material capable of being bound together with a binding agent. In addition, the sheets to be bound together may be of varying sizes or configurations, and varying numbers of sheets may be bound together throughout the stack.

With the present invention, one may choose which sheets 10–15 within the stack 16 are to be bound together. Based on this determination, a binding agent such as toner is selectively applied to edges of particular sheets within the stack 16. For example, a binding agent would typically be applied to a left edge, such as edge 21A of sheet 10, for binding the left edges of particular sheets. With the binding agent selectively applied to the sheets, the stack 16 is then placed within a binding device which activates the binding agent and selectively binds together the particular sheets within the stack 16.

Figure 2:
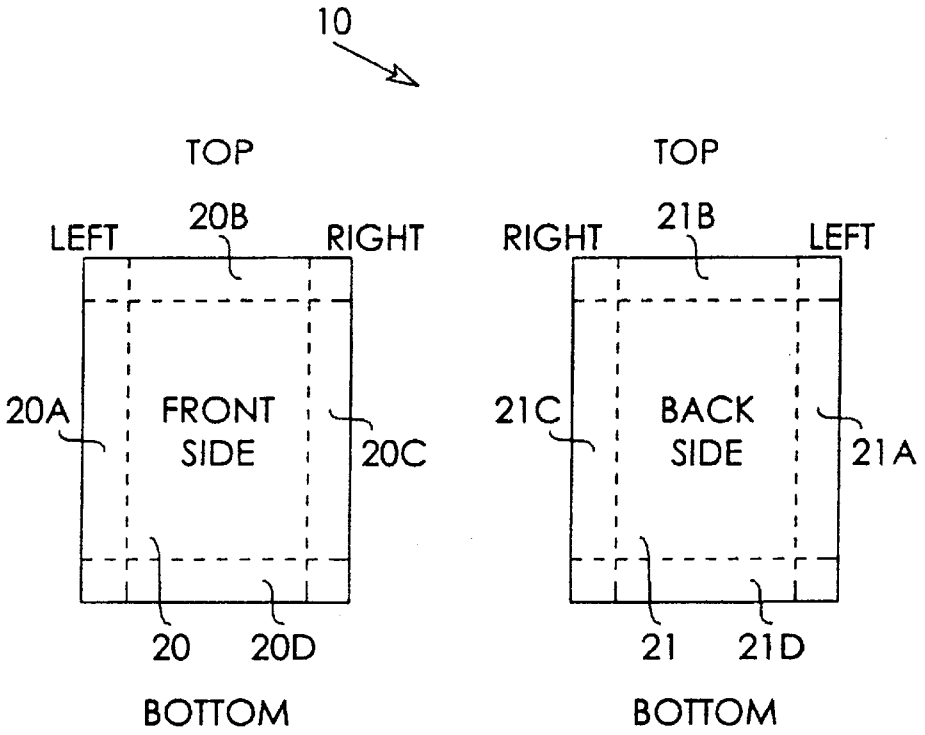
FIG. 2 is a diagram of both sides of one particular sheet within the stack of sheets.

FIG. 2 shows a front 20 and back 21 of sheet 10, as representative of each of the sheets 10–15. The binding agent is preferably applied to both the front and back of sheets to be bound together. The front 20 includes edges 20A–20D, and the back 21 includes edges 21A–21D. The binding agent may be selectively applied to these edges during the printing process based on how the sheets are to be bound together. The binding agent is typically applied to opposing edges (front and back) of sheets to be bound, such as edge 21A of sheet 10 and edge 20A of sheet 11 for book-type binding. Alternatively, the binding agent may also be applied to other edges such as 21B (sheet 10) and 20B (sheet 11) for top-edge binding. The end result is that the stack 16 is bound into, for example, a plurality of booklets such as 22A–22N, having bound edges 20A, shown in FIG. 3.

Figure 3:
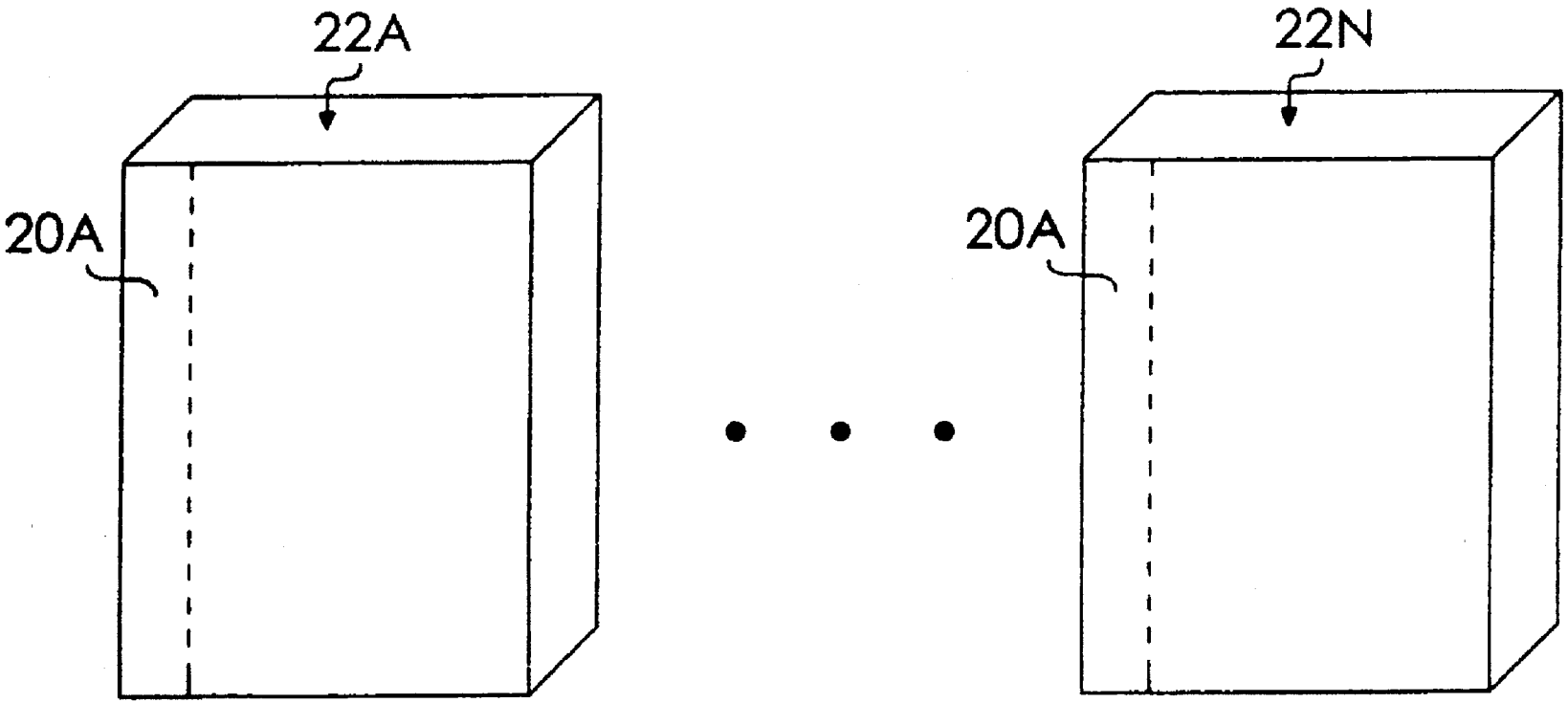
FIG. 3 is a diagram of selectively bound portions of the stack shown in FIG. 1.

While the booklets in FIG. 3 are shown having book-type binding, one may choose which edge or edges are to be bound together and thus vary edges to be bound within each booklet and among different booklets in the stack. For example, a first booklet in the stack may have a left-edge binding, a second booklet in the stack may have top-edge binding, and a third booklet in the stack may have top-edge binding of the first two sheets combined with left-edge binding of the second and remaining sheets. The present invention provides the advantage of allowing a user to choose which sheets and edges of sheets throughout the stack are to be bound together, placing the binding agent in the desired locations.

As an example, one may desire to book-type bind together sheets 10–12 and separately bind sheets 14–15 in the stack 16 of FIG. 1, while leaving sheet 13 separate and unbound. In this example, the binding agent is applied to edge 21A of sheet 10, edges 20A and 21A of sheet 11, and edge 20A of sheet 12. Likewise, the binding agent is applied to edge 21A of sheet 14 and edge 20A of sheet 15. When the stack 16 is then placed within a binding device, as explained below, the binding agent binds together sheets 10–12 and separately binds sheets 14–15. Sheet 13 remains as a separate sheet, because no binding agent is placed between sheets 12 and 13, nor sheets 13 and 14. Accordingly, the present invention allows the separate binding of two or more different booklets without having to separate those booklets from the stack. This is only one example of how the sheets may be bound together. A user may bind the sheets in any desired fashion varying both the edges to be bound and the sheets to be bound, all controlled by the computer when the stack is created. As shown, single sheets may be left unbound within the stack by the selective placement of the binding agent.

Binding Agents

The present invention uses a binding agent for selectively binding together particular sheets within the stack of sheets. These binding agents may include, for example, a toner binder, an ultraviolet (UV) light-activated adhesive, or a pressure-activated adhesive. Techniques for toner binding are described in the following U.S. patents, and the disclosures of all of these patents are incorporated herein by reference as if fully set forth: U.S. Pat. Nos. 3,817,815; 3,843,483; 3,943,024; 4,061,523; 4,149,288.

These patents describe how a toner may be applied to edges of sheets. In a mechanical apparatus shown in these patents, gripper bars grip the edges to be bound together and vibrate the sheets in order to generate heat and melt the toner, which results in the toner adhering to and binding the sheets.

Another type of binding agent is a UV light-activated adhesive. With this adhesive, UV light illuminating the adhesive causes it to bind together the sheets on which it is applied.

Another binding agent is a pressure-activated adhesive. This pre-applied adhesive is microencapsulated so that when it is subjected to sufficient pressure the capsules break open and release adhesive, thus binding together the sheets on which it is applied. An example of such a pressure-activated adhesive is Pressure-Seal™ adhesive, a Moore Business Forms, Inc. product.

Printing and Binding Apparatus and Method

Figure 4:
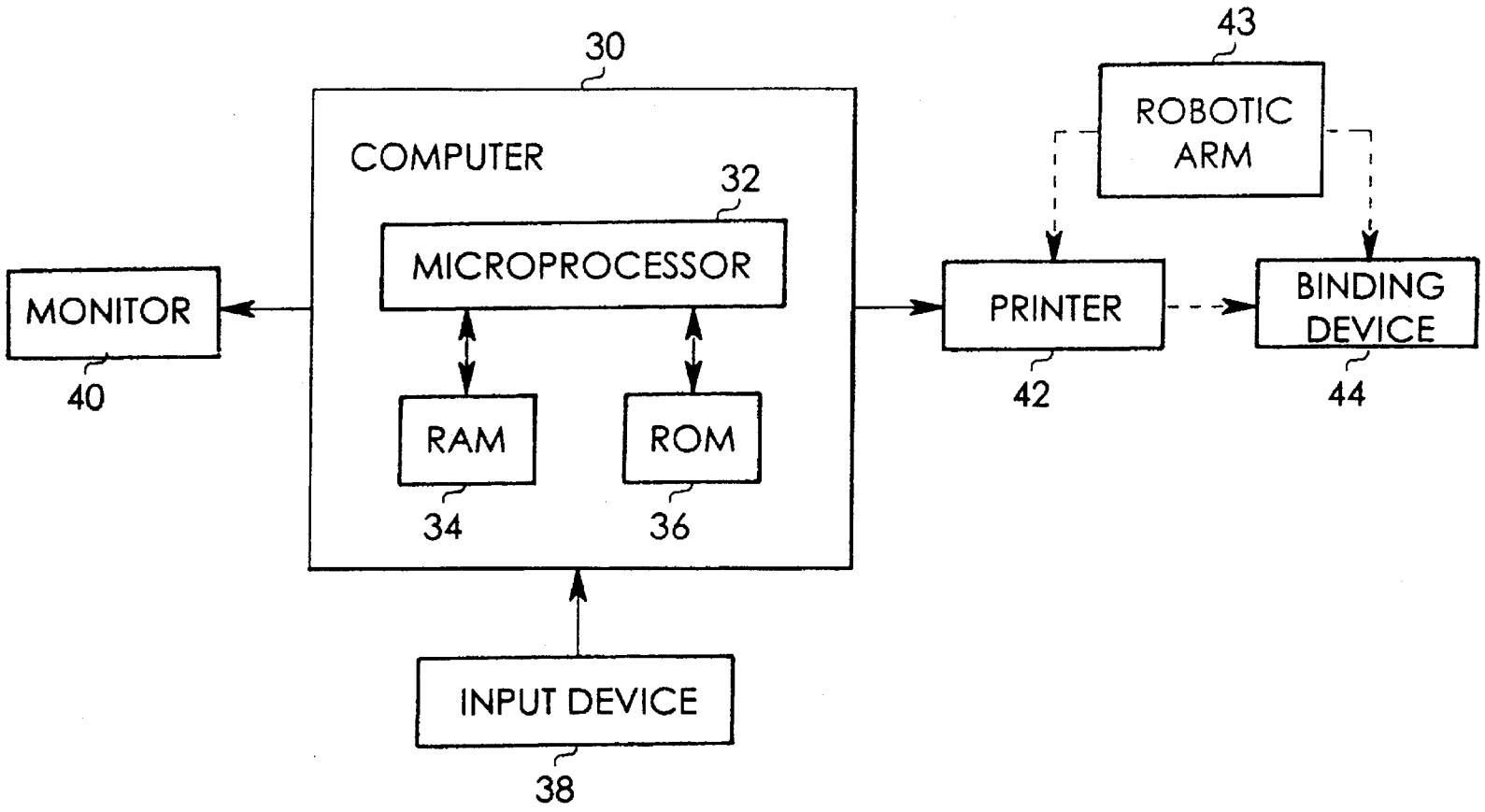
FIG. 4 is a block diagram of an apparatus for implementing the present invention.

FIG. 4 is a block diagram of an exemplary apparatus for performing the variable printing and selective binding of booklets. The apparatus includes a computer 30. The computer 30 is a typical digital computer, such as a personal computer, which includes a microprocessor 32 for controlling operation of the computer 30 and executing programs. The computer 30 also includes a random access memory 34 and read-only memory 36. The computer 30 may be interfaced to a monitor 40, such as a typical monochrome or color computer monitor. An input device 38 may be used for entering information or commands into the computer 30. The input device 38 may be implemented with, for example, a keyboard, cursor control device such as "mouse," and modem or other network or channel connection. The computer 30 is electrically connected to a printer 42 for printing information onto sheets or other materials and assembling the printed sheets into a stack. A binding device 44 selectively binds the printed sheets generated by the printer 42.

Figure 5:
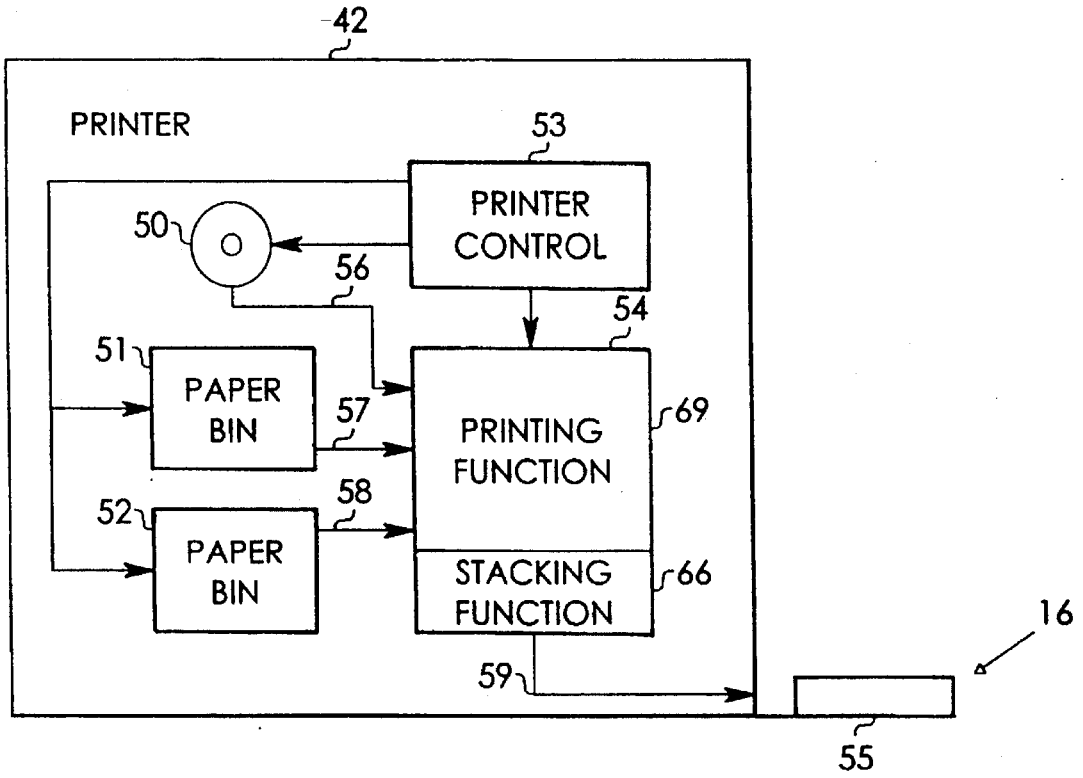
FIG. 5 is a block diagram of a printer.

FIG. 5 is a block diagram of the basic functions of the printer 42. Printer 42 is typically implemented with a conventional laser printer and includes a printer control 53 which controls the various functions within the printer 42. An example of a duplex (prints both sides of a sheet in a single process through the printer) color laser printer, which produces high quality printed sheets is the Xerox 390HC or 350HC printer, or IBM 3900 duplex printer. While a preferred embodiment is shown as using a laser printer, other printers or printing devices are possible for implementing the present invention. The use of a computer printer with the present invention has advantages over, for example, photocopy devices which simply reproduce printed information fed into them. While a photocopy device can produce multiple identical copies of a single printed document, it only produces a variable output if it is fed variable input information printed on sheets or other tangible materials. A computer printer has the advantage of operating under electronic program control in order to print variable sets of information on sheets to be bound together.

The printer control 53 controls the selection of sheets, such as paper or other materials, for printing. Sheets may be selected from, for example, a paper roll 50, bin 51, or bin 52, or more bins if the printer has greater than two input bins. If paper is selected from the roll 50, the printer 42 typically includes a cutting device for cutting sheets from the roll 50. It is well known that a printer may include separate bins for storing different types, colors, or sizes of paper or other materials, and the printer 42 may be controlled to select sheets from the various bins 51 and 52, or the paper roll 50. Sheets may also be selected from fan or accordion fold paper.

The printer control 53 also controls the unit 54, which includes a printing function 69 and stacking function 66. The printing function 69 receives sheets from paths 56–58 and applies toner to print information on the sheets. With a toner binder, the toner is applied during the printing process, since it is the same toner used to print information on the sheets. If an adhesive type binding is used, then sheets with adhesive already applied may be stored in the bins 51 and 52. The use of different bins for storing sheets either with or without adhesive allows for selective binding of sheets with an adhesive type binder. For example, bin 51 may include sheets without adhesive and bin 52 may include sheets with adhesive applied to the left edge. By controlling the particular bin from which the printer selects sheets for printing, one may determine which sheets within the printed stack of sheets will be bound together. While only two bins are shown, the printer 42 may be implemented with a printer having additional bins for binding of different edges of the sheets.

The printer 42 also includes an output tray 55 which receives the printed sheets from path 59. Since the sheets are printed in the order in which they are to be selectively bound and subsequently distributed and consumed, the printing of the sheets also accomplishes sequencing and assembling of the sheets into a stack 16 ready for selective binding. Sequencing involves arranging the sheets in the order in which they are to be bound. The sequencing may also accomplish the assembling of the sheets into a stack. Thus, the printing, sequencing, and assembling functions may all occur within a printer. Stacking function 66 often allows for offsetting the individual sheets by booklet (intended) under program control.

Figure 6:
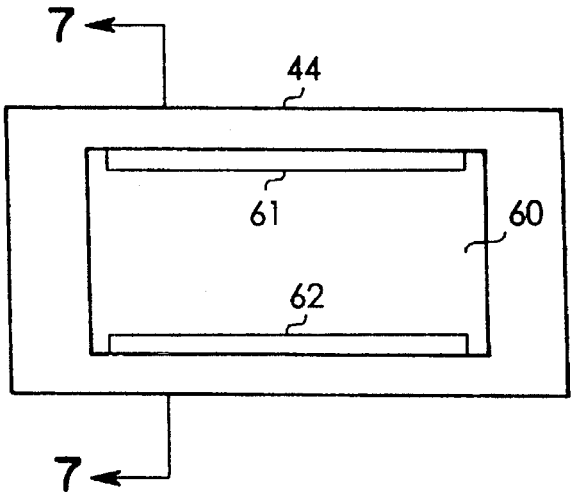
FIG. 6 is a top view of a binding device.

FIG. 6 is a top view of the binding device 44. The binding device 44 includes a slot 60 into which a user places the stack 16 to be bound, typically with the left edge facing downward for book-type binding. Two members 61 and 62 then press together the edge to be bound and apply heat and/or pressure to activate the toner selectively applied to the sheets and thus effect the binding process. If other edges are to be bound, then those edges of the stack 16 may also be placed in the binding device 44 for binding of those edges, or the binding device may have members 61 and 62 replicated on two or more sides, such that multiple edges of stack 16 are simultaneously bound. The binding may occur according to the toner binding explained in the patents cited above.

If a UV light-activated adhesive is used, then the members 61 and 62 may be configured to apply pressure and illuminate with UV light the edge of the stack placed within the binding device in order to activate the adhesive and accomplish the selective binding. If a pressure-activated adhesive is used, then the members 61 and 62 may be configured to apply pressure to the edge of the stack placed within the binding device in order to accomplish the selective binding.

In one embodiment, therefore, a user would manually take the stack 16 from the printer and place it into the binding device 44. Alternatively, a mechanical device, such as a robotic arm 43 (see FIG. 4), may automatically transfer the stack 16 from the printer 42 to the binding device 44 in order to accomplish the binding. Any number of low complexity robots can be configured to pick up the stack and place it for binding, and subsequently stack bound booklets in a distributing sequence. An example of one such robotic arm is a SCARA or selective compliant assembly robotic arm, a standard industry device such as the Linear Company Robotic system.

While the binding device 44 is shown as a physically separate unit from the printer 42, the printer 42 could be modified to include the binding function. However, since the printer 42 is usually a readily available component, it is often technologically easier to implement the binding in a separate physical unit as opposed to modifying an existing printer.

Figure 7:
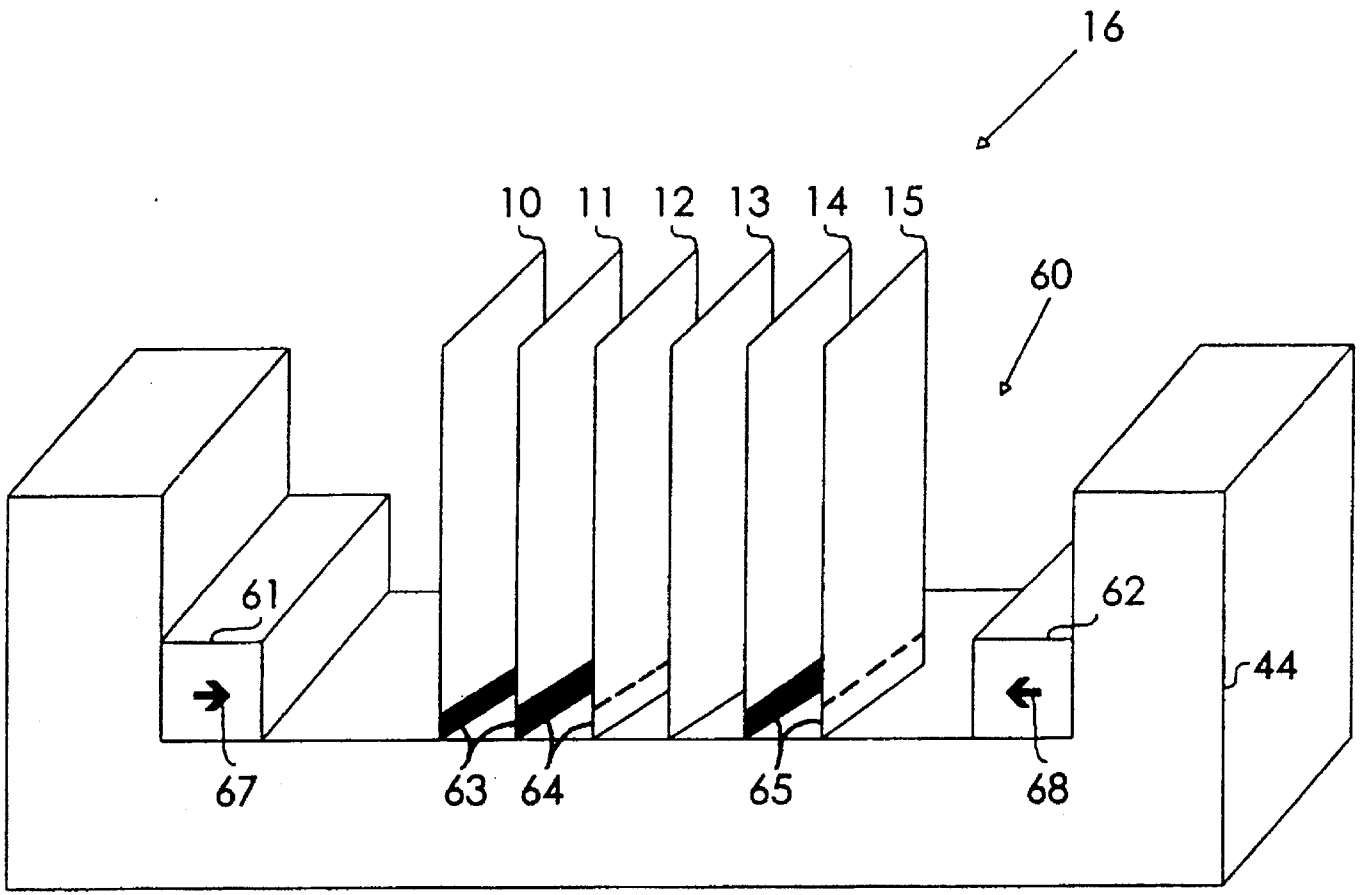
FIG. 7 is a perspective view of the binding device shown in FIG. 6 taken along lines A—A and showing an example of selective binding.

FIG. 7 is a perspective view of the binding device 44 shown in FIG. 6 taken along lines A—A. This view also illustrates an example of selective binding by showing how the stack 16 may be placed within the slot 60 on its left edge, such as left edge 20A of sheet 10. Using the above example where sheets 10–12 and 14–15 are to be individually bound with sheet 13 left unbound, this view shows conceptually the selective placement of toner between sheets 10 and 11 (63), sheets 11 and 12 (64), and sheets 14 and 15 (65). During the binding process, the members 61 and 62 apply pressure, and typically vibrations to generate heat, in the direction shown by arrows 67 and 68 in order to accomplish the selective binding. Since no toner is placed between the edges of sheets 12 and 13 nor sheets 13 and 14, sheet 13 will not be bound. If other edges are to be bound, a user may place those edges of stack 16 in slot 60 and repeat the binding process, or the members 61 and 62 may be replicated on additional sides.

Figure 8:
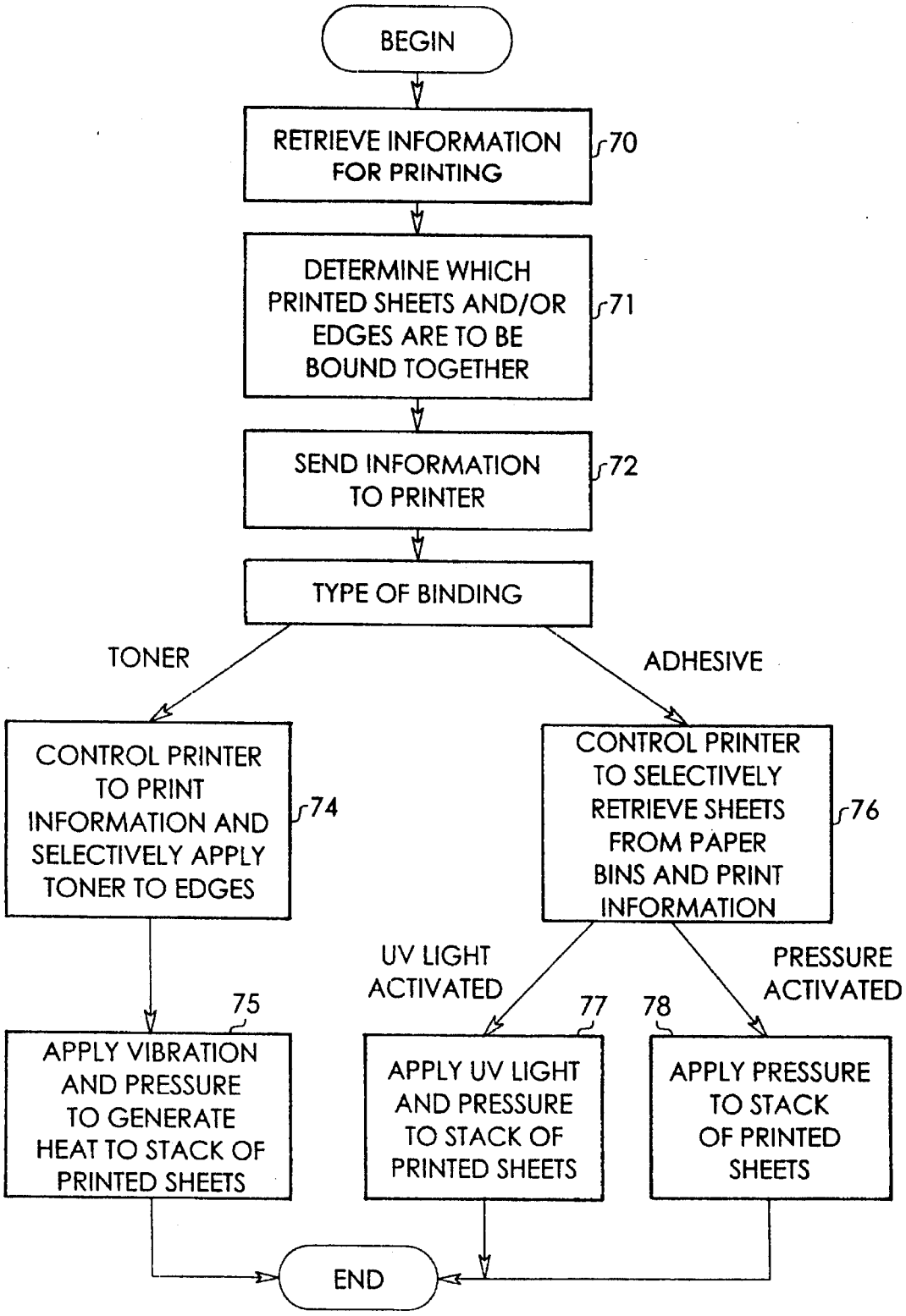
FIG. 8 is a flow chart of a process for printing and binding according to the present invention.

FIG. 8 is a flow chart of a printing and binding process according to the principles of the present invention. The process involves retrieving information for printing at step 70. It is well known how a print job may be assembled within a computer and subsequently transmitted to a printer. For example, a computer program may be used to generate a series of different or the same documents and send those documents to the printer for printing. Such system software as Postscript™, Quark™, and AFP™ when used in conjunction with custom application software can be used to control the printer operation and thus the binding adhesive placement. At step 71, the process determines which of the printed sheets and/or edges are to be bound together. For example, as part of the word processing or custom application software process, the information to be printed may contain control codes which instruct the printer when to apply the toner to the various edges of the sheets or the bin from which to select sheets for printing.

This information is sent to the printer at step 72. This includes both the information to be actually printed on the sheets and the information regarding which edges and sheets are to receive the toner or, in the case of adhesive binding, the bins from which to select sheets for printing. If the sheets are to be bound with a toner, the process involves controlling the printer to print the information and selectively applying toner to the edges (step 74). Next, the stack of printed sheets is selectively bound in the binding device at step 75.

If the binding involves adhesive, the process involves controlling the printer to selectively retrieve sheets from bins and print the information (step 76). If the adhesive is a UV light-activated adhesive, then the binding device applies UV light and pressure to the stack of printed documents to effect the binding process. Otherwise, if adhesive is a pressure-activated adhesive, the process involves applying pressure to the stack of printed documents (step 78) in the binding device in order to effect the binding process.

While the present invention has been described in connection with a preferred embodiment thereof, it will be understood that many modifications will be readily apparent to those skilled in the art, and this application is intended to cover any adaptations or variations thereof. For example, different sizes of sheets or materials for the sheets may be used without departing from the scope of the invention. It is manifestly intended that this invention be limited only by the claims and equivalents thereof.

What is claimed is:

1. A method of variably printing information on a plurality of sheets and selectively binding the sheets, comprising the steps of:

using a printer in order to print variable sets of information on a plurality of sheets, sequence the printed sheets, and assemble the printed sheets into a stack; and selectively binding together particular sheets within the stack of printed sheets.

2. The method of claim 1 wherein the printing step comprises the step of laser printing the variable sets of information.

3. The method of claim 1 wherein the printing step comprises the step of duplex printing the variable sets of information.

4. The method of claim 1 wherein the printing step comprises the step of color printing the variable sets of information.

5. The method of claim 1 wherein the printing step comprises the step of printing the variable sets of information on physically separate sheets which comprise the plurality of sheets.

6. The method of claim 1 wherein the printing step comprises the step of cutting the plurality of sheets from a paper roll.

7. The method of claim 1 wherein the binding step comprises the step of binding the particular sheets using a toner binder activated by heat.

8. The method of claim 7 wherein the printing step further comprises the step of applying the toner binder to the particular sheets to be bound together.

9. The method of claim 1 wherein the binding step comprises the step of binding the particular sheets using an adhesive binder activated by pressure.

10. The method of claim 9 wherein the binding step further comprises the steps of:

applying the adhesive binder to the particular sheets to be bound together; and applying pressure to the stack of printed sheets.

11. The method of claim 1 wherein the binding step comprises the step of binding together particular edges of the particular sheets.

12. The method of claim 1 wherein the binding step is performed within the printer.

13. The method of claim 1 wherein the binding step is performed on a device physically separate from the printer.

14. The method of claim 1 wherein the printing step comprises the step of printing varying educational test booklets on the plurality of sheets.

15. The method of claim 1 wherein the printing step comprises the step of printing the sets of information on paper sheets.

16. A system for variably printing information on a plurality of sheets and selectively binding the sheets, comprising:

a printer;

a computer electrically coupled to the printer, the computer being programmed to control the printer in order to print variable sets of information on a plurality of sheets, sequence the printed sheets, and assemble the printed sheets into a stack; and a device for selectively binding together particular sheets within the stack of printed sheets.

17. The system of claim 16 wherein the printer comprises a laser printer and the computer is programmed to control the printer in order to laser print the variable sets of information.

18. The system of claim 16 wherein the printer comprises a duplex laser printer and the computer is programmed to control the printer in order to duplex print the variable sets of information.

19. The system of claim 16 wherein the printer comprises a color printer and the computer is programmed to control the printer in order to color print the variable sets of information.

20. The system of claim 16 wherein the printer comprises means for printing the variable sets of information on physically separate sheets which comprise the plurality of sheets.

21. The system of claim 16 wherein the printer comprises means for cutting the plurality of sheets from a paper roll.

22. The system of claim 16 wherein the device for binding comprises means for binding the particular sheets using a toner binder activated by heat.

23. The system of claim 22 wherein the computer is programmed to control the printer in order to apply the toner binder to the particular sheets to be bound together.

24. The system of claim 16 wherein the device for binding comprises means for binding the particular sheets using an adhesive binder activated by pressure.

25. The system of claim 24 wherein the device for binding further comprises:

means for applying the adhesive binder to the particular sheets to be bound together; and means for applying pressure to the stack of printed sheets.

26. The system of claim 16 wherein the device for binding comprises means for binding together particular edges of the particular sheets.

27. The system of claim 16 wherein the printer further comprises the device for binding.

28. The system of claim 16 wherein the device for binding is physically separate from the computer and the printer.

29. The system of claim 16 wherein the computer is programmed to control the printer in order to print varying educational test booklets on the plurality of sheets.

30. The system of claim 16 wherein the computer is programmed to control the printer in order to print the sets of information on paper sheets.

31. A method of variably printing information on a plurality of sheets and selectively binding the sheets using a toner binder, comprising the steps of:

using a printer which applies toner in order to print variable sets of information on a plurality of sheets;

selectively applying the toner to edges of particular sheets to be bound together within the plurality of sheets;

sequencing and assembling the printed sheets into a stack; and binding together the particular sheets within the stack of printed sheets.

32. A method of variably printing information on a plurality of sheets and selectively binding the sheets using an adhesive binder, comprising the steps of:

receiving a plurality of sheets having an adhesive selectively applied to particular sheets to be bound together within the plurality of sheets;

using a printer in order to print variable sets of information on the plurality of sheets;

sequencing and assembling the printed sheets into a stack; and binding together the particular sheets within the stack of printed sheets.

* * * * *